United States Patent [19]

Kr mer

[11] Patent Number: 4,704,251

[45] Date of Patent: Nov. 3, 1987

[54] METHOD FOR THE PRODUCTION OF A WEAR RESISTANT PART OF A SOIL WORKING TOOL

[75] Inventor: Ole Kræ mer, Hillerød, Denmark

[73] Assignee: Teknologisk Institut, Tåstrup, Denmark

[21] Appl. No.: 885,204

[22] Filed: Jul. 14, 1986

[30] Foreign Application Priority Data

Jul. 18, 1985 [DK] Denmark ..... 3281/85

[51] Int. Cl.[4] ..... C22C 32/00

[52] U.S. Cl. ..... 419/17; 75/235; 75/236; 75/240; 75/244; 419/12; 419/13; 419/18; 419/19; 419/23; 419/29; 419/54; 428/908.8

[58] Field of Search ..... 75/236, 235, 240, 244; 419/17, 23, 29, 54, 12, 13, 18, 19; 428/908.8

[56] References Cited

U.S. PATENT DOCUMENTS

| | | | |
|---|---|---|---|
| 2,672,426 | 3/1954 | Grubel et al. | 419/17 |
| 3,493,351 | 2/1970 | Bergna et al. | 419/17 |
| 3,809,540 | 5/1974 | Mal | 419/17 |
| 3,967,935 | 7/1976 | Frehn | 419/17 |

FOREIGN PATENT DOCUMENTS 46209 2/1982 European Pat. Off. .

OTHER PUBLICATIONS

R. C. D. Richardson, "The Wear of Metallic Materials by Soil-Practical Phenomena", in *J. Agric Engng. Res.* (1967) 12 (1), 22-39.

*Primary Examiner*—Stephen J. Lechert, Jr.
*Attorney, Agent, or Firm*—Watson, Cole, Grindle & Watson

[57] ABSTRACT

Method for the production of a wear resistant part of a soil working tool comprising forming a mixture of 67-90% by volume of iron particles consisting of at least 97% Fe and 10-33% by volume of hard particles having a desired particle size distribution, and subsequently pressing the mixture at a pressure of at least 3500 kp/cm$^2$ to form a compact, sintering the compact at a temperature of 900°-1200° C., and optionally sinter forging the sintered compact. The sintered part consists of an iron matrix in which hard particles with a predetermined particle size distribution are embedded.

9 Claims, No Drawings

METHOD FOR THE PRODUCTION OF A WEAR RESISTANT PART OF A SOIL WORKING TOOL

BACKGROUND OF THE INVENTION

The invention relates to a method for the production of a wear resistant part of a soil working tool, the wear resistant part essentially consisting of an iron matrix having hard particles embedded therein.

The term wear resistant part means herein a part of a soil working tool which is in contact with the soil to be worked, and which consequently is subject to wear. Typical wear resistant parts are plough shares, harrow tooth tips, discs for disk harrows, blades for rotary cultivators, and seed spouts for seeding machines.

It is well known to produce wear resistant parts by melting and subsequently casting carbon containing iron under such conditions that the carbon is separated in the form of free iron carbide particles. The material thus produced, white cast iron, has a very high hardness and resistance to wear.

Likewise, it is well known to produce wear resistant parts by melting and subsequently rolling an iron alloy.

European patent application No. 0 046 209 A1 discloses wear resistant parts comprising 30–80% by weight of a carbide material and 20–70% by weight of a matrix material selected from the group consisting of steel, steel and iron, steel and copper, and steel and nickel, carbide material being embedded in and bonded to matrix. The wear resistant parts are prepared by subjecting a mixture of hard carbide particles and metal powder to a cold isostatic compaction to form a compacted preform. The compacted preform is then sintered at a temperature of about 1050° C. for about 1 hour and subsequently the sintered body is isostatically pressed at a temperature of about 1230° C. for about 1 hour at a pressure of above 700 kg/cm$^2$, and preferably about 1050 kg/cm$^2$, under a protective atmosphere. These operations are time consuming and the use of a high temperature at a high pressure and under a protective atmosphere requires a complicated equipment.

Furthermore it is well known, cf. R. C. D. Richardson: The Wear of Metallic Materials by Soil—Practical Phenomena, J. agric. Engng Res. (1967) 12 (1), 22–39, that the particle size distribution of the hard particles in a matrix of the type specified above is an important parameter of the wear resistance of wear resistant parts of soil working tools, and that optimum wear resistance is obtained by adapting the particle size distribution of the hard particles to the soil type to be worked.

With the known methods for the production of wear resistant parts it is practically impossible to obtain a predetermined particle size distribution in the finished wear resistant part.

The object of the invention is to provide a simple method of the type defined above which does not suffer from this drawback.

SUMMARY OF THE INVENTION

According to the invention this object is obtained by a method which is characterized in forming a mixture of 67–90% by volume of iron particles consisting of at least 97% Fe and 10–33% by volume of hard particles having a desired particle size distribution, pressing the mixture at a pressure of at least 3500 kp/cm$^2$ to form a compact, sintering the compact at a temperature of 900°–1200° C., and optionally sinter forging the sintered compact to obtain the desired shape.

Comparative laboratory investigations of the wear resistance of harrow tooth tips produced by the method of the invention and conventional harrow tooth tips produced by forging and rolling have shown that the former have a wear resistance which is three times that of the latter. Since about 3000 tons of material annually is worn away in connection with soil working in Denmark alone (ploughing, harrowing, sowing, etc.) it is understood that the said increased wear resistance will result in considerable savings in resources and money.

Another advantage offered by wear resistant parts produced by the method of the invention is that hard particles obtained from easily available and inexpensive starting materials may be included herein. Examples of such hard particles are particles of $Fe_3C$, $Al_2O_3$, $SiO_2$, SiC, $Si_3N_4$, BC, BN, FeB, WC og TiC.

Particularly suitable hard particles are particles of $Al_2O_3$ produced by mixing stoichiometric amounts of iron oxide particles and aluminium powder and igniting this mixture, and by subsequently subdividing the material thus formed into fine particles. This method results in particles consisting of an aluminium oxide core surrounded by iron. These particles are easily sintered together with iron, and by this method a material is obtained having a considerably higher density than a material obtained by using a starting material consisting of a simple mixture of iron particles and aluminium oxide particles.

The reason for this is that the starting materials do not have to be soluble in the molten matrix material as is the case with the known method.

The hardness of the hard particles used depends on the soil type which is to be worked, but in any case the hardness must be above 10,000 N/mm$^2$ determined by means of a micro-Vicker measuring apparatus (cf. DS/ISO 4516).

As mentioned above, it is also desirable to adapt the particle size distribution of the hard particles to the soil type to be worked. In practice hard particles of a particle size ranging from 50–400 μm are preferably used.

The iron powder used in connection with the method of the invention normally contains small amounts of carbon in the form of graphite and optionally one or more additional elements. Thus, the iron particles typically contain carbon in an amount of less than 0.1, e.g. 0.08%.

The other elements, if any, may be, e.g., nickel, chromium, and silicium.

As mentioned above, the mixture consists of 67–90% by volume of iron particles and 10–33% by volume of hard particles. In practice it is preferred to use 70–85% by volume of iron particles and 15–30% by volume of hard particles in the form of SiC.

The mixing of the iron particles and the hard particles should be so carefully done that the relatively few hard particles will be evenly dispersed in the mass of iron particles. The mixing is expediently carried out in a V-mixer.

As mentioned, the pressing of the mixture of iron particles and hard particles is carried out at a pressure of at least 3500 kp/cm$^2$, and a pressure of about 5000 kp/cm$^2$ is preferably used. The subsequent sintering is effected within a temperature range of 900°–1200° C. and preferably at a temperature between 980° and 1150° C. and particularly about 1080° C.

The subsequent sinter forging, if any, is expediently carried out in a sinter forging tool.

It should be noted that it is well known to produce articles containing a major amount of iron and one or more carbides by a powder metallurgical technique. These well known methods normally require the use of considerable amounts of additives in the form of pure elements such as wolfram, chromium, nickel, molybdenum, and vanadium. Because of the high costs such elements, however, cannot be economically used in wear resistant parts of soil working tools. Besides the primary object of the well known methods is to produce cutting tools for metal working.

DESCRIPTION OF A PREFERRED EMBODIMENT

Example

The following starting materials were used:

| | |
|---|---|
| Graphite powder | 2.5% by volume |
| Lubricant in the form of zinc stearate | 1.8 by volume |
| Silicon carbide powder, density: 3.2 g/cm$^3$ | 20 by volume |
| Iron powder containing 0.07% C and 0.005% S | 75.7 by volume |

The starting materials mentioned were mixed in a V-mixer for 15 minutes. The powder mixture formed was then transferred to a cylindrical pressure chamber provided with two pistons opposite to one another. The transfer was carried out with great care to avoid segregation as far as possible.

The powder mixture was pressed under a pressure of 5000 kp/cm$^2$ to obtain a compact with a final volume of about 20% of the original volume of the mixture.

The compact was then heated in a furnace to 600° C. causing the lubricant to evaporate and then to a sintering temperature of 1080° C. for 17–20 minutes under pure hydrogen.

After leaving the furnace the sintered body was placed in a forging press. A temperature of about 950° C. was maintained during the forging operation.

After removal of the body from the forging tool it had a temperature of about 600° C. and it was cooled in oil.

A sample produced as described above was subjected to a test to determine its relative wear resistance. In this wear test an area of the dimensions 9.60×2.5 cm was brought in contact with abrasive paper under a pressure of 1 kg. The abrasive paper used had a coating of SiC particles of different particle sizes. The sample consisted of a matrix obtained from iron particles with a content of 2.5% by volume of C containing 20% by volume of SiC having a particle size of about 290 μm. A comparison was made with steel 37 (of a $HV_{30}$-hardness=1180 N/mm$^2$).

The following results were obtained:

| Particle size of abrasive particles, mesh | Relative wear resistance based on steel 37 |
|---|---|
| 320 | 4.4 |

I claim:

1. A method for the production of a wear resistant part of a soil working tool, said wear resistant part consisting essentially of an iron matrix having hard particles embedded therein, said method including the steps of (1) forming a mixture of 67–90% by volume of iron particles consisting of at least 97% Fe and 10–33% by volume of hard particles having a desired particle size distribution, (2) pressing the mixture at a pressure of at least 3500 kg/cm$^2$ to form a compact, and (3) sintering the compact at a temperature of 900°–1200° C. to form said wear resistant part.

2. A method as in claim 1, wherein said mixture formed in step (1) includes 70–85% by volume of iron particles and 15–30% by volume of hard particles.

3. A method as in claim 1, wherein said hard particles have a hardness of above 10,000 N/mm$^2$ as determined by means of a micro-Vickers measuring apparatus.

4. A method as in claim 1, wherein said hard particles consist of SiC.

5. A method as in claim 1, wherein said hard particles have particle sizes ranging from 50 and 400 μm.

6. A method as in claim 1, wherein said hard particles have a carbon content of less than 0.1%.

7. A method as in claim 1, wherein in step (2) said mixture is pressed at a pressure of about 5000 kg/cm$^2$, and in step (3) is sintered at a temperature of about 1080° C.

8. A method as in claim 1, including after step (3) a step of sinter forging said wear resistant part.

9. A method of producing a soil working tool which includes a wear resistant part that consists essentially of an iron matrix having hard particles embedded therein, said method including the steps of (1) forming a mixture of 67–90% by volume of iron particles consisting of at least 97% Fe and 10–33% by volume of hard particles having a desired particle size distribution, (2) pressing the mixture at a pressure of at least 3500 kg/cm$^2$ to form a compact, (3) sintering the compact at a temperature of 900°–1200° C. to form said wear resistant part, and (4) attaching said wear resistant part to a soil working tool.

* * * * *